US007845815B2

(12) United States Patent
Yu et al.

(10) Patent No.: US 7,845,815 B2
(45) Date of Patent: Dec. 7, 2010

(54) STRAW CUP WITH VARIABLE LIGHTS

(76) Inventors: Wei Hung Yu, 16 Faith, Irvine, CA (US) 92612; Connie Wang, 16 Faith, Irvine, CA (US) 92612

( * ) Notice: Subject to any disclaimer, the term of this patent is extended or adjusted under 35 U.S.C. 154(b) by 165 days.

(21) Appl. No.: 12/379,558

(22) Filed: Feb. 25, 2009

(65) Prior Publication Data

US 2010/0214765 A1 Aug. 26, 2010

(51) Int. Cl.

| | |
|---|---|
| ***F21V 33/00*** | (2006.01) |
| ***F21S 8/00*** | (2006.01) |
| ***F47G 21/18*** | (2006.01) |
| ***A61J 15/00*** | (2006.01) |
| ***A47G 19/22*** | (2006.01) |

(52) U.S. Cl. ..... 362/101; 239/18; 239/33; 220/710

(58) Field of Classification Search ..... 362/101; 23/33, 18; 220/710

See application file for complete search history.

(56) References Cited

U.S. PATENT DOCUMENTS

| | | | | |
|---|---|---|---|---|
| 5,070,435 | A * | 12/1991 | Weller | 362/101 |
| 6,591,524 | B1 * | 7/2003 | Lewis et al. | 40/324 |
| 6,796,671 | B2 * | 9/2004 | Rudell et al. | 362/101 |
| 7,452,092 | B2 * | 11/2008 | Vanderschuit | 362/96 |
| 7,674,001 | B1 * | 3/2010 | Ferrin et al. | 362/101 |
| 2002/0043513 | A1 * | 4/2002 | Lipson | 215/388 |

* cited by examiner

*Primary Examiner*—Jong-Suk (James) Lee
*Assistant Examiner*—David J Makiya
(74) *Attorney, Agent, or Firm*—Bacon & Thomas, PLLC

(57) ABSTRACT

The present invention relates to a straw cup with variable lights, primarily comprising of a set of light-emitting diodes surrounding the inside of the cup's straw, a circuit controller board, and power switch; when the power is activated, the liquid inside the straw's cup refracts and directs light, increasing the variation and brilliance of the twinkling lights and thus further increasing the variation of the straw cup's multicolored lights.

3 Claims, 5 Drawing Sheets

STRAW CUP WITH VARIABLE LIGHTS

BACKGROUND OF THE INVENTION

1. Field of the Invention

The present invention provides a straw cup with variable lights, specifically light-emitting diodes controlled by a circuit board that are intercalated between the straw and the cup, which produce dazzling light refraction and direction when a liquid beverage is drunk from the cup.

2. Description of the Prior Art

To add atmosphere to customers' enjoyment of drinks, many coffeehouses and restaurants serve coffee, fruit juice and other drinks in specially-designed cups, so that while customers enjoy their drinks' flavor and aroma, there is added visual enjoyment. Additionally, people often use straws to drink beverages in order to maintain proper posture, making a specially-designed straw another important focal point for business owners wishing to cultivate a certain atmosphere. The inventor has therefore created a straw cup, combining a straw and a cup, and given it a distinctive appearance, with the straw winding around the outside of the body of the cup so that while people are enjoying a beverage they may also appreciate the beauty of the colorful drink winding its way around the cup.

SUMMARY OF THE INVENTION

The primary purpose of the present invention: to provide a straw cup with changing lights, light-emitting diodes controlled by a circuit board that are intercalated between the straw and the cup, thereby increasing both overall and aesthetic value.

BRIEF DESCRIPTION OF DRAWINGS

This invention is better understood by referring to the accompanying drawings, wherein.

DETAILED DESCRIPTION OF THE PREFERRED EMBODIMENT

Figure 1:
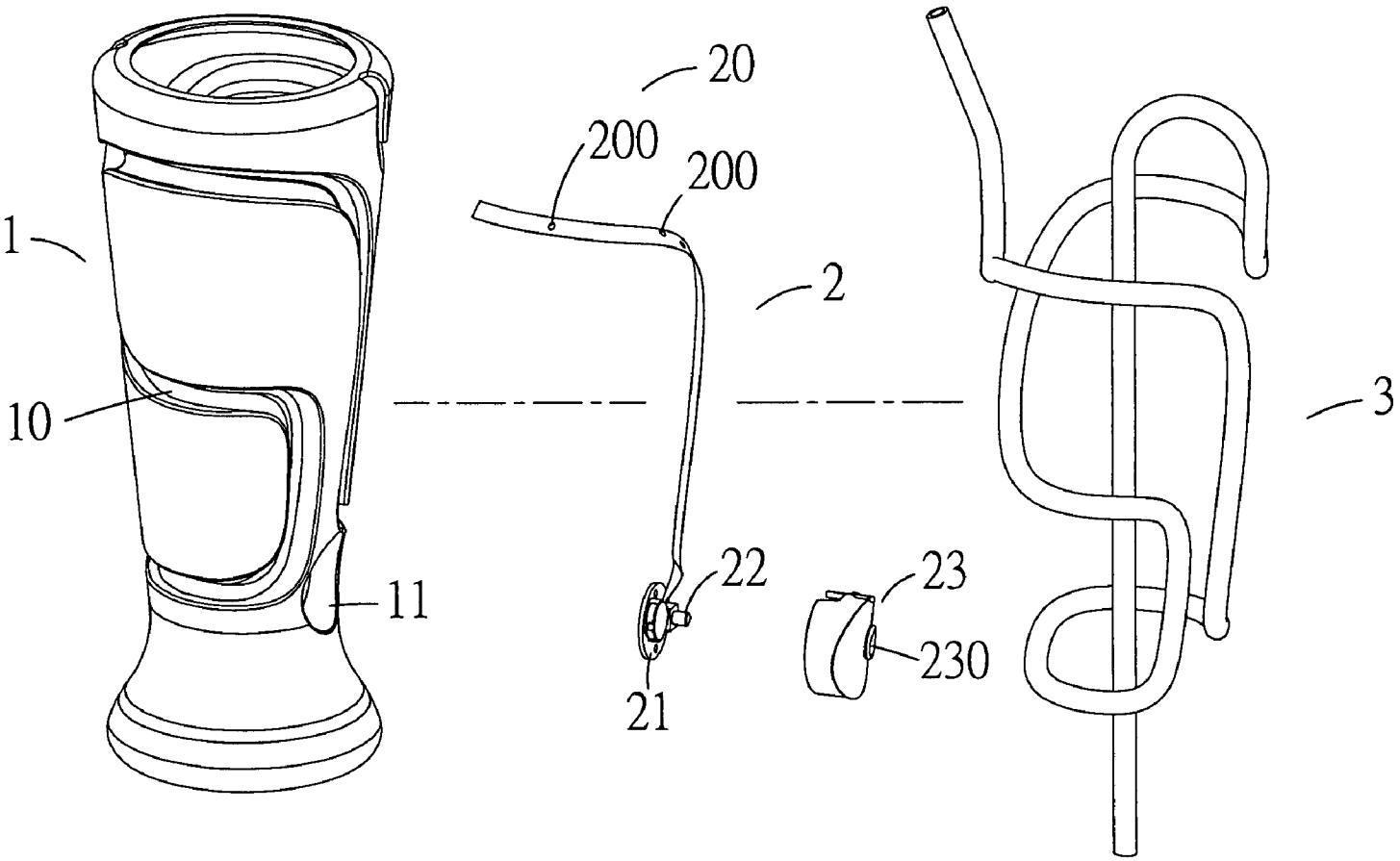
FIG. 1 is an exploded perspective view of the straw cup with variable lights in the present invention.
Figure 2:
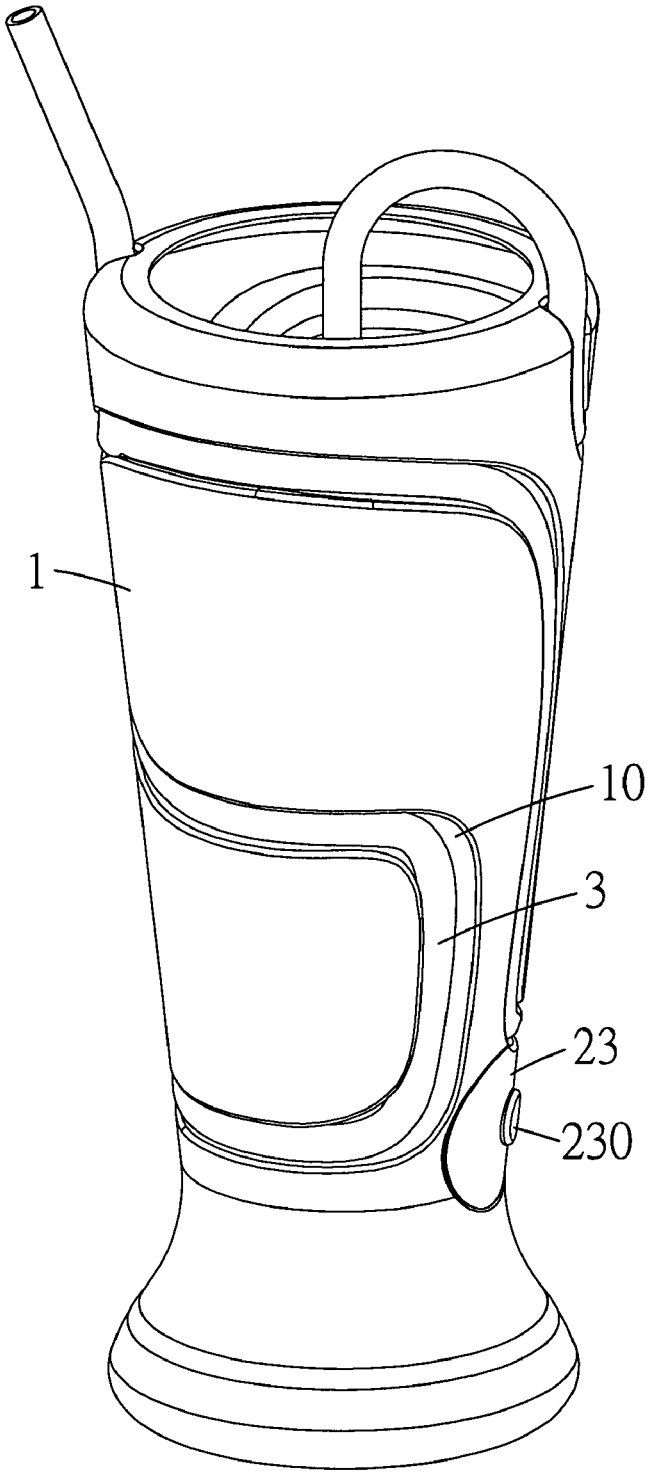
FIG. 2 is a perspective view of the straw cup with variable lights in the present invention.
Figure 3:
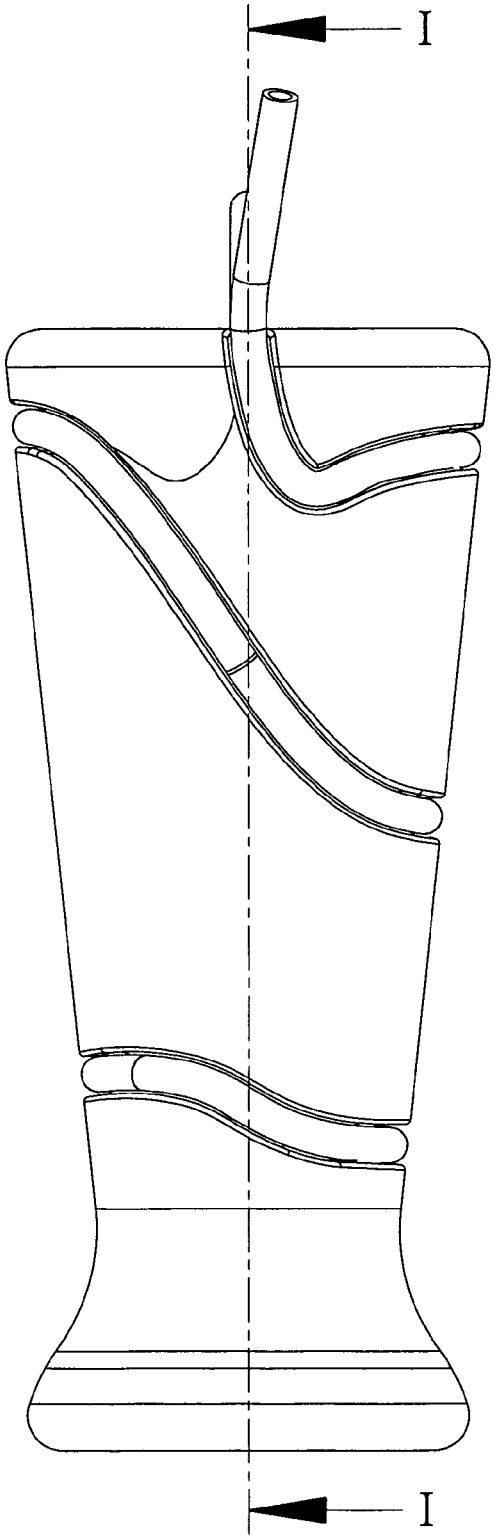
FIG. 3 is a side-view of the straw cup with variable lights in the present invention.
Figure 4:
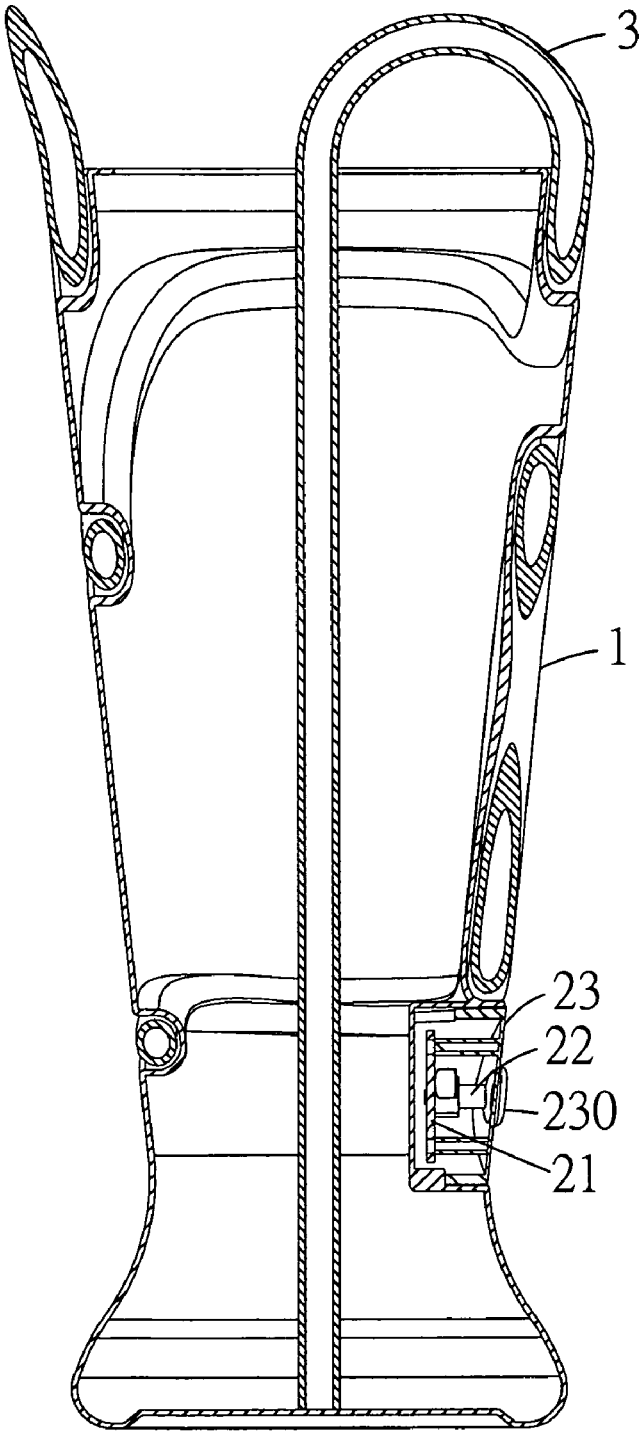
FIG. 4 is a cross sectional view, taken along line I-I of FIG. 3.
Figure 5:
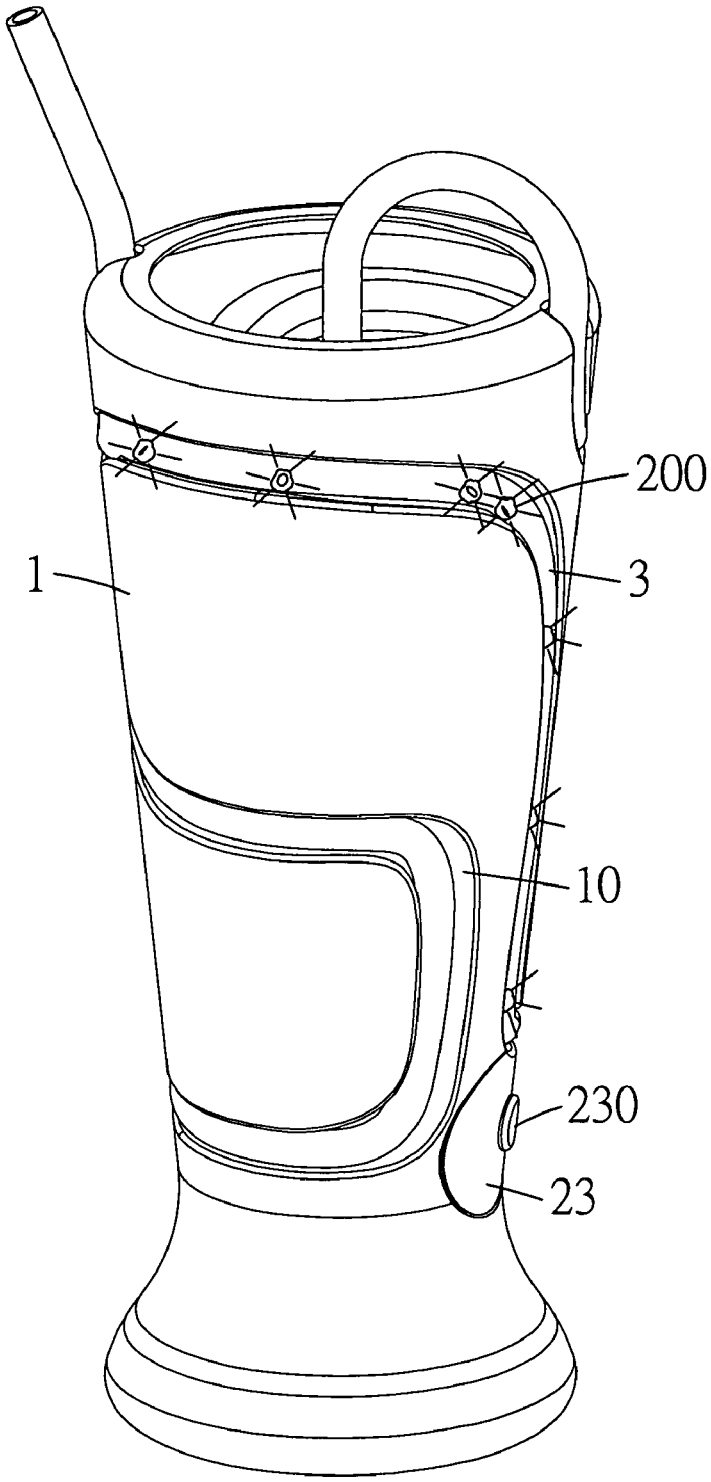
FIG. 5 is perspective view of the straw cup with variable lights in using condition in the present invention.

As shown in FIGS. 1~5, a preferred embodiment of a straw cup with variable lights in the present invention includes a cup 1, light-emitting system 2, and straw 3.

As shown in FIG. 1 to 5, the surface of the cup 1 has a straw insertion groove 10 and a power switch slot 11.

The light-emitting system 2 is fitted inside the straw insertion groove 10 and the power switch slot 11. The light-emitting system 2 includes a light-emitting diode string 20, a circuit controller board 21, power supply switch 22, and a elastic member 23. Light-emitting diode string 20 is comprised of a number of light-emitting diodes 200, and each light-emitting diode 200 has a minimum of more than one different colored light source. The circuit controller board 21 is connected to the light-emitting diode string 20, and has both with a timer and electrical circuit, allowing the light-emitting diode string 20 to twinkle in sequence, alternating between different colored light-emitting diodes 200. Power switch 22 provides power to the integrated circuit controller board and light-emitting diode string 20; the power switch 22 is inserted inside the power switch slot 11 (it can be turned on or off by touch, electromagnetism, sound, light, or other methods), and the elastic member 23 has a depressible section 230 with two separate parts for activation and deactivation.

The straw 3 wraps around the cup 1 inside the straw insertion slot 10, and is located over the top of the light-emitting diode string 20.

When assembling, the light-emitting diode string 20 is first fixed inside the cup's 1 straw insertion groove 10, and the circuit controller board 21 and power switch 22 are inserted inside elastic member 23, after elastic member which 23 is inserted inside the power switch slot 11 and, finally, the straw 3 is placed in the straw insertion groove 10, completing the simple assembly of a straw cup with variable lights.

When using, the cup 1 is filled with a liquid beverage and when the user wants to drink the beverage in the cup 1 through straw 3, pressing the depressible section 230 of the elastic member 23 will activate the power switch 22, the light-emitting diode string 20 will emit colorful light through the straw 3 and beverage and the light source will gradually change and twinkle in sequence, making the light-emitting diode 200 seem to change as the liquid flows through the straw 3.

The above explanation shows that this invention has the following advantages:

1. The present invention gives allows the straw cup great practicality and variability.

2. The present invention's light-emitting diodes 200 are comprised of a minimum of more than one different color of light, increasing the variation in flickering lights.

3. The present invention's light-emitting diode string 20 is controlled by the circuit controller board 21, enabling lights to shine in sequence variation between different light sources.

4. The present invention's elastic member 23 can completely fill the power switch slot 11, providing protection from dampness inside.

While the preferred embodiment of the invention has been described above, it will be recognized and understood that various modifications may be made therein and the appended claims are intended to cover all such modifications that may fall within the spirit and scope of the invention.

What is claimed is:

1. A straw cup with variable lights, comprising:

a cup, its surface provided with a straw insertion groove and power switch slot;

a light-emitting system attached to the cup's outer surface, comprised of: an light-emitting diode string, circuit controller board, power switch, and elastic member;

a straw, fit inside the straw insertion groove winding around the cup, and placed over the top of the light-emitting diode string;

which can, through the combination of the above components, emit varying and regular changes in light and produce the effect of refracting and directing the colorful light as the liquid flows through the straw.

2. A straw cup with variable lights as claimed in claim 1, wherein the light-emitting diodes are of a minimum of more than one color.

3. A straw cup with variable lights as claimed in claim 1, wherein the power switch can be activated by touch, electromagnetism, sound, light, and other methods.

* * * * *